US009845802B2

(12) United States Patent
Ruatto et al.

(10) Patent No.: US 9,845,802 B2
(45) Date of Patent: Dec. 19, 2017

(54) INTAKE CHARGED PUMP FOR DELIVERING A LIQUID

(71) Applicant: ZF Friedrichshafen AG, Friedrichshafen (DE)

(72) Inventors: Paolo Ruatto, Eriskirch (DE); Stephan Brussa, Langenargen (DE); Marco Rosendahl, Rieste (DE); Thomas Kramer, Oldenburg (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 933 days.

(21) Appl. No.: 13/650,186

(22) Filed: Oct. 12, 2012

(65) Prior Publication Data

US 2013/0094948 A1 Apr. 18, 2013

(30) Foreign Application Priority Data

Oct. 13, 2011 (DE) ..... 10 2011 084 405

(51) Int. Cl.
*F04D 1/00* (2006.01)
*F04C 2/344* (2006.01)
(Continued)

(52) U.S. Cl.
CPC ..... *F04C 2/344* (2013.01); *F04C 11/006* (2013.01); *F04C 15/062* (2013.01); *F04C 29/12* (2013.01)

(58) Field of Classification Search
CPC ..... F04C 2/344; F04C 15/062; F04C 11/006; F04C 2/3442; F04C 3/3443; F04C 2/3446;
(Continued)

(56) References Cited

U.S. PATENT DOCUMENTS 2,983,226 A * 5/1961 Livermore ..... F04C 15/062 417/310
2,985,357 A * 5/1961 Carolan ..... A62B 9/00 128/204.25
(Continued)

FOREIGN PATENT DOCUMENTS

DE 37 35 929 A1 5/1989
DE 39 28 029 A1 3/1990
(Continued)

OTHER PUBLICATIONS

German Search Report dated Feb. 13, 2013.

*Primary Examiner* — Devon Kramer
*Assistant Examiner* — Connor Tremarche
(74) *Attorney, Agent, or Firm* — Davis & Bujold, PLLC; Michael J. Bujold

(57) ABSTRACT

An intake charged pump for pumping liquid and which has an intake duct that extends to the suction area of the pump. The pump has a duct through which a jet stream flows to the suction area. A nozzle arrangement in the intake duct accelerates the liquid which is returned via the jet stream and supports the suction of a suction stream of the liquid from a storage container. A nozzle of the nozzle arrangement leads into the mixing chamber at an acute angle in a such way that the jet stream, leaving the nozzle, creates a common mixing stream with the suction stream from the storage container, and through which partial streams having essentially the same pressure and energy content, can be delivered to the front and back suction pockets of the double chamber pump.

10 Claims, 2 Drawing Sheets

(51) Int. Cl.
*F04C 11/00* (2006.01)
*F04C 15/06* (2006.01)
*F04C 29/12* (2006.01)

(58) Field of Classification Search
CPC .... F04C 15/0023; F04C 29/12; F04C 29/026; F04C 23/008; F01C 21/0809; F01C 21/0818; F01C 21/0827; F01C 21/0845; F01C 21/0881; F01C 1/3446; F01C 1/3448; F01C 1/44; F01C 1/46; F04F 5/02; F04F 5/10
USPC ..... 417/88, 87, 204, 310; 415/182.1
See application file for complete search history.

(56) References Cited

U.S. PATENT DOCUMENTS 3,551,073 A * 12/1970 Petrovits ..... F02C 7/236 417/151
3,614,266 A * 10/1971 Ciampa ..... F04C 2/3446 417/310
3,930,760 A * 1/1976 Winter ..... F04C 14/26 417/310
4,971,525 A 11/1990 Nakayoshi et al.
5,496,152 A * 3/1996 Heise ..... F04C 15/062 239/600
6,244,830 B1 * 6/2001 Agner ..... F01C 21/0863 417/204

FOREIGN PATENT DOCUMENTS

DE 41 38 516 A1 5/1993
DE 197 16 175 A1 10/1998
DE 198 36 628 A1 2/2000
DE 100 44 610 A1 4/2002
DE 102 16 549 A1 10/2002

* cited by examiner

INTAKE CHARGED PUMP FOR DELIVERING A LIQUID

This application claims priority from German patent application serial no. 10 2011 084 405.8 filed Oct. 13, 2011.

FIELD OF THE INVENTION

The invention concerns an intake charged pump for delivering a liquid.

BACKGROUND OF THE INVENTION

Such pumps can be, for instance, part of power steering assist systems in motor vehicles in which they generate the hydraulic pressure of a servo liquid for a piston-cylinder configuration which supports the required steering forces at the steering wheel of a motor vehicle. In another example, they can also be part of the vehicle transmission were they provide the hydraulic pressure of a transmission oil to lubricate and/or activate (changing of a gear ratio, engaging/disengaging of transmission shafts) in the motor vehicle transmission. Preferably, this is a vane type pump as described in DE 39 28 029 A1 and in DE 41 38 516 A1, and where the content is in here fully disclosed. Such vane type pumps draw the oil out of a supply container, which is external to the pump, and are usually equipped with a flow controlling valve through which the oil is conveyed from the high-pressure area to the intake of the pump. Starting at a certain pump rotational speed or rather a certain flow rate, the flow control valve opens so that the oil, which is at high-pressure, can exit in to a pressure duct through which it passes into the suction area of the pump.

Known from DE 41 38 516 A1 is an intake charged pump which, to guarantee highly reliable and low noise operation and while preventing the creation of cavities and sound from drawn in air bubbles, is equipped with an additional injector at high oil pressure, and through which the oil can be channeled from the intake channel into the intake of the pump. Hereby, adequate filling of the intake of the pump shall be achieved under all operating conditions and, due to the adequate supply of oil to the intake, damages which are caused by cavities can be avoided. The embodiment example which is presented and described therein refers to the fact that the center axis of the injector matches the center axis of a channel section which leads into the intake of the pump, and also matches a center axis of an output bore of the flow control valve. It is also mentioned and noted that it is possible to pivot the center axis of the injector with respect to the other two axes, for instance to the right, so that the fluid which is under high-pressure and flowing through the injector, as well as its entrained oil, and that the intake of the pump, even with a different configuration of the parts, can be filled at an optimum with fluid to be transported.

In addition to DE 41 38 516 A1, the document DE 198 36 628 A1 mentions that the injector device is effective just at one side of the housing with a jet nozzle and from there on needs to direct the fluid from a tank to both sides of the enclosure to the respective intake, to provide the fluid for the suction pockets which are positioned on both sides of the transport device or the rotational group, respectively, in an adequate level. Due to the different lengths of the flow paths to the suction pockets on both sides, different pressure conditions occur in the fluid, which causes different load levels at the suction pockets on both sides. This causes, especially at large transport outputs of the pump, the cavities or rather damage due to cavities. In addition, an equal filling of the suction areas on both sides is doubtful.

To avoid these problems, DE 198 36 628 A1 proposes that the feed duct on both sides of the transport device each leads with one partial duct into a jet chamber, and that the injector device emits the oil on both sides so that at least one jet nozzle is aiming into each of the two jet chambers of the injector device. From that point, the fluid flows, via branching intake ducts, to diametrically opposed suction pockets of a dual-chamber vane type pump, which are mainly designed as having equal lengths so that the same pressure conditions in the suction area and the same fluid volume is provided at both sides. However, the fluid which is ejected from the jet nozzles hits a perpendicular wall of the jet chambers which results in a loss of kinetic energy and prevents an even pressure reduction in the direction of the suction pockets.

Although DE 102 16 549 A1 mentions that a pump of a similar type includes flow separators for the oil return flow which divide the oil return flow in a way such that the partial flows have the same energy content and load pressure at all suction pockets so that in particular the same energy content of the flow, as well as the same load pressure can be provided to all four suction pockets. This arrangement also requires sharp redirecting edges and impact surfaces which create losses of kinetic energy of the stream.

The previously mentioned vane type pumps or roller cell pumps, however, are designed in a compact manner, but have the previously mentioned disadvantages due to their compactness.

SUMMARY OF THE INVENTION

Based on that background, the object of this invention is to propose an intake charged pump for delivering a liquid, especially for a motor vehicle, which is constructed in a simple way and which brings a jet stream of a liquid under pressure from the pressure area to the intake area of the pump, whereby assisting the suction of the liquid through the pump takes place by means of a storage container with high efficiency.

The invention relates to an intake charged pump for conveying a liquid, especially of a motor vehicle, and having an inner space in a housing, an intake duct for the liquid which extends to the intake area of the pump, a pressured duct which is connected with a pressure area of the pump through which a jet stream can be conveyed from the pressure area to the intake area of the pump, and a nozzle arrangement in the intake duct for accelerating the liquid which recirculates with the jet stream, and for supporting the suction of an intake stream of the liquid from a storage container. The liquid which has to be conveyed can be in particular, based on the application of the pump, oil, hydraulic liquid, brake fluid, water, or gasoline. The pump is mainly designed as a vane cell, or gear wheel pump, or roller cell pump.

To achieve the stated objective, the pump is provided with an intake duct that is positioned in front of the housing of the pump and designed in particular as a cylindrical mixing chamber, the suction stream can be fed into the mixing chamber and a nozzle of the nozzle configuration is directed at an acute angle into the mixing chamber, such that the jet stream discharged from the nozzle creates a common mixing stream with the intake suction stream from a supply container, through which portions of the flow having the same pressure are directed at least to a front suction pocket and a back suction pocket of the dual-flow pump. Preferably, the nozzle of the nozzle configuration is aimed and directed in such a way that the injected partial flows for the suction pockets also have substantially the same energy content.

The term "front" and "back" is herein to be understood in reference to the length of the distance which the partial stream travels to the respective suction pocket. That means that the suction pockets in the back is the suction pocket to which the respective partial stream travels a longer way, while the front section pocket is the suction pocket to which the respective partial stream, here as reference, travels a shorter way.

Contrary to the previously discussed state of the art, the inventive pump does not need any special, constructive design for guiding fluid to the areas of the rotor with abrupt changes of the direction and sharp redirecting edges. The separation of the partial flows to the opposing suction pockets arises from the mentioned, special nozzle configuration which creates, in the mixing chamber, a common stream including a jet stream and suction stream through which partial streams, having substantially the same pressure, and if necessary the same energy content, arrives at the front and back suction area of the dual-flow pump. This creates a very steady run of the pump with a low possibility of creating cavities, which allows the pump to operate with low noise and low wear.

It is provided, in accordance with a further embodiment of the invention that, beginning at the mixing chamber, the housing of the pump has in a front intake area at least a front suction pocket and in the intake area in the back at least one suction pocket, wherein the front and the back suction pockets are positioned diametrically opposite each other, and the back suction pocket is connected with the output side end of the mixing chamber via a ring duct.

A further embodiment of the invention provides that the nozzle opens into the mixing chamber at such an angle $\alpha$, that a first partial stream leads to the front suction pocket, which is created by mixing the jet stream with the sucked in suction stream, and that a second partial stream, which leads to the back suction pocket, is mainly directed at the inner wall of the mixing chamber to the ring duct and from there to the back suction pocket.

Through the ring duct, which is preferably designed as an inner shell surface of the pump housing, the liquid is conducted directly to the back suction pump by radially streaming around the rotor of the pump in the ring duct. The dimensions of the ring duct are set such that, considering the fluid pressure at the input of the ring duct and the friction losses at the walls of the ring duct at the input to the back suction pocket, a second partial stream arrives which has substantially the same pressure and energy content as the first partial stream at the input of the front suction pocket.

In accordance with another further embodiment, to provide a sufficiently large inflow cross section into the pump, the suction pockets are designed in pairs with one on each side of the housing and both housing lids. Thus, the pump has at least a pair of front and back suction pockets at the sides of the housing lids.

Regarding the nozzle, an advantageous nozzle configuration comprises of a carrier plate with a nozzle that is directed into it or is inserted into it. The carrier plate can hereby be part of a suction filter housing which is connected with the pump or a single part which is clipped to the output of the pressure duct into an accommodating groove of the suction filter housing. The carrier plate can also be fixed in the holding groove by other means, for instance through adhesives or clamping.

In a specific design with respect to the arrangement and orientation of the nozzle, to produce the desired two partial flows it is considered advantageous, to set the longitudinal axis of the nozzle at an angle $\alpha$ of approximately 15° to 45° in reference to the longitudinal axis of the mixing chamber. As such, the longitudinal axis of the nozzle is essentially the axis along which the liquid from the nozzle flows, but it can also be a geometric center axis of an inner chamber in which the liquid from the nozzle passes through. The longitudinal axis of the mixing chamber, is in particular, the axis along which the liquid flows in the mixing chamber, but it can also be a geometric center axis of an inner chamber in which the liquid passes through.

It is preferred that the longitudinal axis of the nozzle, as viewed in a vertical longitudinal section, has an offset of an angle $\alpha$ of approximately 15° to 45° in relation to the longitudinal axis of the mixing chamber. It can also be provided as an alternative that the longitudinal axis of the nozzle, as viewed in a horizontal longitudinal section plane, runs at an angle of approximately 15° to 45° in relation to the longitudinal axis of the mixing chamber. Hereby, a favorable separation of the partial streams to the suction pockets is achieved and which have the same pressures. The nozzle input in this embodiment can also be positioned, as viewed in the vertical longitudinal section plane and in reference to the longitudinal axis of the mixing chamber, at an axis deviation of approximately 10% to 25% of the diameter of the mixing chamber.

The vertical longitudinal section runs, in particular, vertically to a rotational axis of the pump rotor of the pump, along the longitudinal axis of the mixing chamber. The horizontal longitudinal section plane runs hereby preferably parallel to the rotational axis of the common rotor of the pump along the longitudinal axis of the mixing chamber. The rotational axis is hereby the axis around which the pump rotor in the pump is rotatable positioned. By rotating around the rotational axis when the pump is operated, the pump rotor creates the desired transportion of the liquid. The pump rotor can hereby be for instance a transport gear wheel, if the pump is a gear wheel pump, or a rotary piston if the pump is a rotary piston pump, or a vane, if the pump is a vane cell pump.

It is provided in accordance with an even more concrete embodiment that the longitudinal axis of the nozzle in the vertical longitudinal section plane is tilted at an angle $\alpha$ of approximately 15° to 20° with respect to the longitudinal axis of the mixing chamber. The longitudinal axis of the nozzle runs hereby, or as an alternative to it, in the horizontal longitudinal section plane at an angle of 30° to 35° with respect to the longitudinal axis of the mixing chamber. Hereby, an especially favorable separation of the partial streams to the suction pockets is achieved, each having almost the same pressures. The inlet of the nozzle is positioned, preferably in the vertical longitudinal section plane and with respect to the longitudinal axis of the mixing chamber, at an axis deviation of approximately 15% to 20% of the diameter of the mixing chamber.

Finally, it can be advantageous for additional optimization if the nozzle has inside, with respect to its longitudinal axis, a nonsymmetrical inner shell surface. It is preferably designed so that the jet stream which leaves a nozzle has a twist overlay. This twist guarantees, on one hand, acceptable mixing with the drawn in liquid, and still favors the creation of a partial stream which flows to the back suction pockets of the pump.

The inventive pump is in particular a motor vehicle pump, preferably of a motor vehicle transmission for the transfer of the transmission oil or a power steering assist system for the transfer of a servo liquid of the power steering assist system, because low noise pumps are desired here which are not or only slightly noticeable by the passengers, and which is achieved by the inventive pump. The inventive pump can also be applied in other suitable application needs.

BRIEF DESCRIPTION OF THE DRAWINGS

In the following, the invention is further explained based on the embodiment example presented in the drawing. The drawing shows in FIG. 1 a schematic side sectional view of an intake charged dual-flow pump illustrating a jet stream injected to the pump, the intake suction stream, a mixing stream and the partial streams directed to the front and back suction pockets, FIG. 2 an enlarged vertical longitudinal sectional view of a mixing chamber and a nozzle arrangement in the same, and FIG. 3 a sectional view through the upstream end of the mixing chamber and the nozzle of the nozzle arrangement facing in the direction of the mixing chamber.

DETAILED DESCRIPTION OF THE PREFERRED EMBODIMENTS

Figure 1:
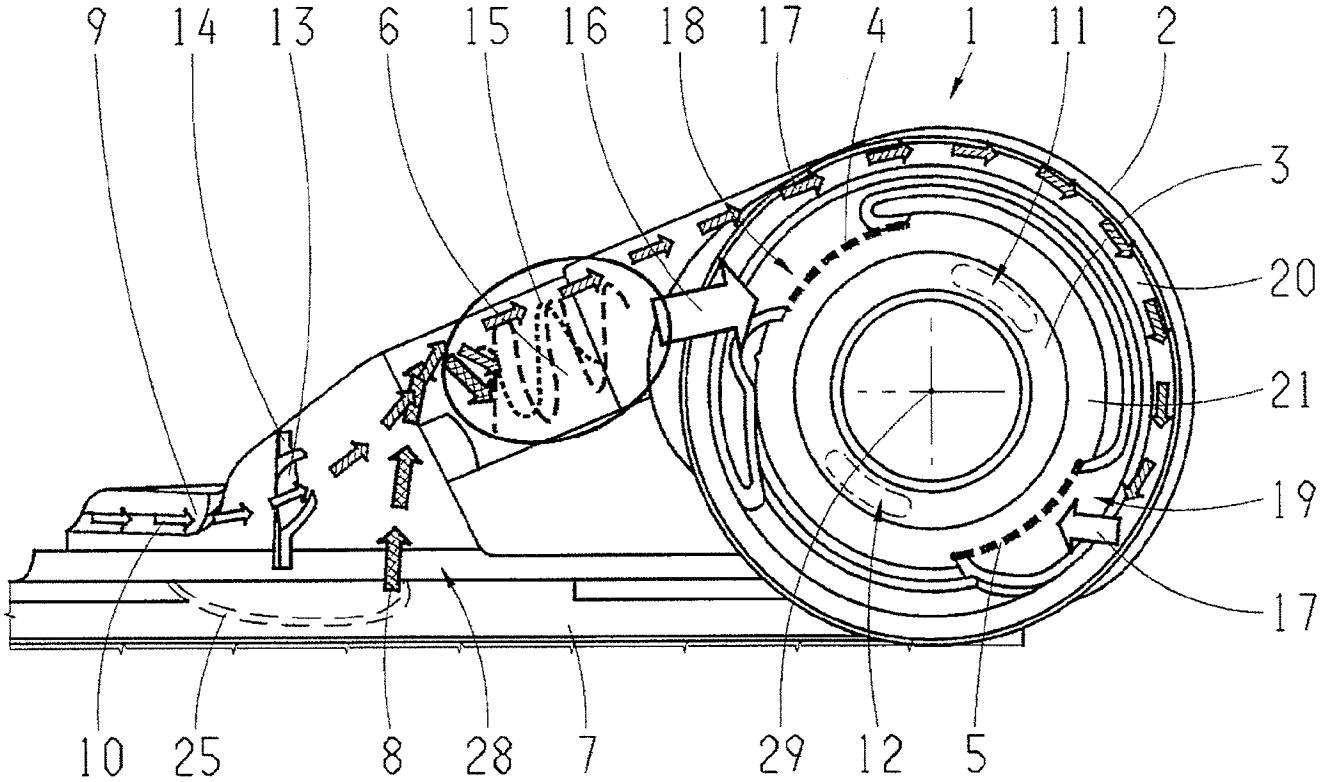

Of a dual flow, intake charged vane cell pump 1 for transporting liquid, in FIG. 1, only a housing 2 with an inner space 3 is presented in a longitudinal sectional view. The presented pump can be in particular an oil pump of a motor vehicle transmission, preferably an automatic transmission, for the lubrication and/or actuation (execution of shift operations or the engaging/disengaging of transmission shafts) of the transmission. The vane cell pump 1 has front and back intake areas 18, 19 that are arranged in pairs with the front suction pockets 4 and the rear suction pockets 5, which are both arranged diametrically opposed to each other at the housing lids 21 of the housing 2. The suction pockets 4, 5 lead into the inner space 3 of the pump. Arranged inside the inner space 3 is a pump rotor, which is not shown for the purpose of clarity, that rotates around a central rotational axis 29. Wherein, because the pump is designed as a vane cell pump, the pump rotor is a vane rotor. In another design of the pump, for instance as a gear wheel pump, a respective other design of the pump rotor will be applied for instance a transportation gearwheel. Depending on the pump design, several pump rotors can be positioned in the inner space 3.

In addition, first and second pressure areas 11, 12 lead into the inner space 3. During the operation of the pump, rotation of the pump rotor around the rotational axis 29 transports the liquid from the suction pockets 4, 5 through the inner space 3 to the pressure areas 11, 12 and beyond.

At the housing 2, a mainly tangentially directed, cylindrical intake duct is positioned, for the liquid which needs to be transported by the pump 1, and which is, in accordance with the invention, mainly designed as a cylindrical mixing chamber 6. The input side of the mixing chamber 6 is connected with a cover of a suction filter housing 7 or directly designed at it. Through an opening 28 in the cover of the suction filter housing 7, the liquid is sucked in from a not shown storage container. In the connecting area of the mixing chamber 6 and the suction filter housings 7, the cover of the suction filter housing 7 is provided with a nozzle configuration which has a carrier plate 14 for a nozzle 13. The carrier plate 14 is, in this embodiment example, fixed into a holding groove 26 of the cover of the suction filter housing 7, especially clipped to it. The nozzle 13 is preferably designed as one piece with the carrier plate 14.

In addition, at the cover of the suction filter housing 7 is a pressure duct 9 through which, when the pump 1 is operated, a jet stream 10, branched off from its pressure area 11, 12, is transported to the nozzle 13 which injects it into the mixing chamber 6. The connecting ducts between the pressure areas 11, 12 and the pressure duct 9 are not shown here for the reason of clarity. This liquid return operation is to be known in vane cell pumps, for instance in power steering assist systems as described for instance in DE 41 38 516 A1. Such pumps are equipped with a not shown flow control valve through which the transported liquid is brought in a controlled way from the high-pressure area of the pump to its intake area.

The exiting jet stream 10 from the nozzle 13 supports the suction of a hydraulic suction stream 8 which flows, through an opening 28 in the cover of the suction filter housings 7 and via a filter 25, to the mixing chamber 6. After combining of the jet stream 10 and the suction stream 8, a mixed stream 15 is created, preferably with a twist overlay in the mixing chamber 6 from which a first partial stream 16 reaches, via a first, front intake area 18, the front suction pockets 4, and a second partial stream 17 reaches, via a second intake area 19, the back suction pockets 5 in the back.

While the first partial stream 16 for the front suction pockets 4 mostly directly reaches the front intake area 18, the second partial stream 17 for the back suction pockets 5 is brought through a ring duct 20 into the housing 2 to the intake area 19 at the back and enters through the suction pockets 5 into the inner space 3 at back of the pump housing 2. Within the ring duct 20, the flow velocity of the second partial stream 17 diminishes up to the intake area 19 in the back, wherein its kinetic energy is almost completely converted in to pressure energy (ram pressure), in so far that the pressure of the second partial stream 17 present at the back suction pockets 5 essentially matches the pressure of the first partial stream 16 present at the front suction pockets 4.

Figure 2:
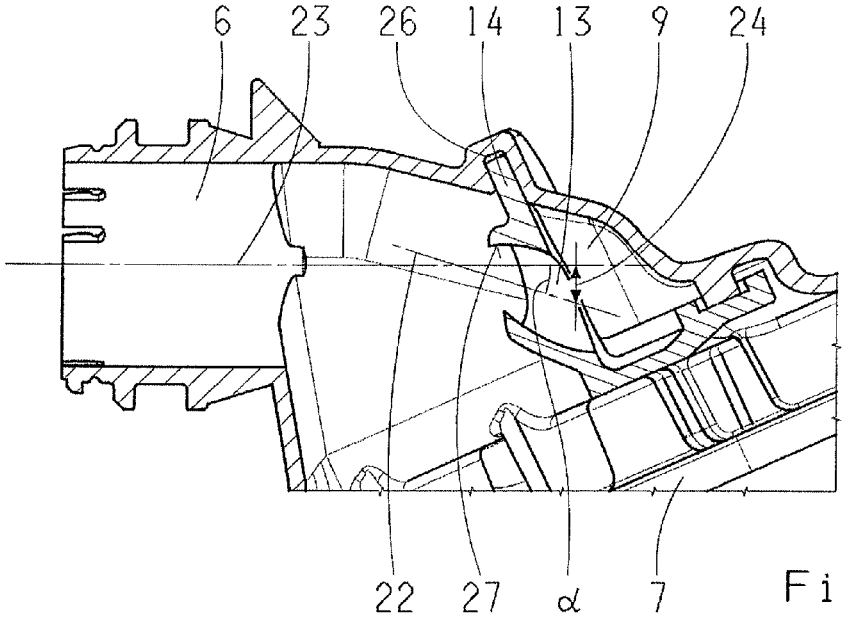
Figure 3:
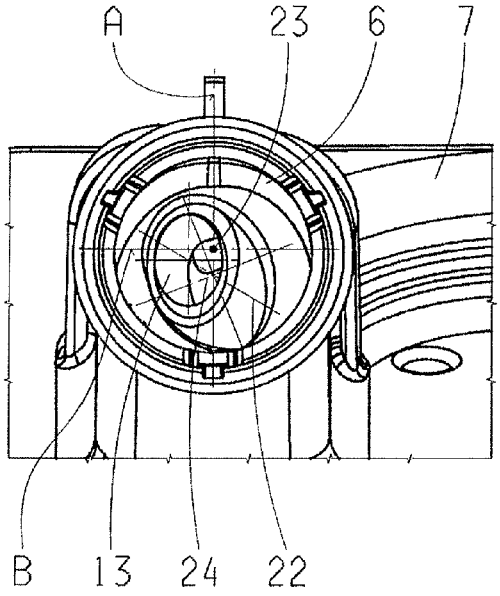

As it can be seen in the FIGS. 2 and 3, the longitudinal axis 22 of the nozzle 13 extends, in a vertical longitudinal sectional plane A (here the drawing plane of FIG. 2, which is perpendicular to the rotational axis 29 and along which the longitudinal axis 22 extends) at an angle $\alpha$ of approximately 15° to 45°, preferably 15° to 20°, with respect to the longitudinal axis 23 of the mixing chamber 6. Also, the longitudinal axis 22 of the nozzle 13 extends in a horizontal longitudinal sectional plane B (here a plane which is perpendicular to the drawing plane of FIG. 2, which runs parallel to the rotational axis 29 along the longitudinal axis 22) at an angle of approximately 15° to 45°, preferably 30° to 35° with respect to the longitudinal axis 23 of the mixing chamber 6. It can also be seen that the inlet of the nozzle 13, in the vertical sectional plane with respect to the longitudinal axis 23 of the mixing chamber 6, is positioned at an axis deviation of approximately 19% to 25%, preferably 15% to 20%, of the diameter of the mixing chamber 6.

Through this positioning of the nozzle 13 with respect to the input side end of the mixing chamber 6, the desired suction of the suction stream 8 and the creation of a mixed stream 15 is achieved, which causes the front suction pockets 4 and the back suction pockets 5 of the dual flow pump 1 to receive the partial streams 16, 17 with the same pressure and energy content. It can be achieved without a complicated construction effort and without significant energy losses at impact walls, so that practically all the energy content of the jet stream 10, which is under high pressure, is available for the intake charging of the vane cell pump 1.

Finally, it can particularly be seen in FIG. 2, that the nozzle 13 has, with respect to its longitudinal axis 22, an asymmetrical inner shell surface 27 which additionally favors the above described creation of flow. Thus, the inner shell surface 27 can be designed in a way that it favors the creation and presence of a very stable partial stream 17 at the outside at the inner wall of the mixing chamber 6, which flows mainly to the back suction pockets 5, while the suction stream 8, which is drawn by the jet stream 10, delivers the front suction pockets 4 with liquid.

REFERENCE CHARACTERS

1 Vane Cell Pump
2 Housing
3 Inner Space
4 Front Suction Pocket
5 Back Suction Pocket
6 Mixing Chamber, Feeding Channel
7 Suction Filter housing, Cover of the Suction Filter housing
8 Suction Flow
9 Pressure Duct
10 Jet Stream
11 Back Pressure Area
12 Front Pressure Area
13 Nozzle
14 Carrier Plate
15 Mixed Stream
16 Partial Stream to the Front Suction Pockets
17 Partial Stream to the Back Suction Pockets
18 Front Intake area
19 Back Intake area
20 Ring Duct
21 Housing Cover
22 Longitudinal Axis of the Nozzle
23 Longitudinal Axis of the Mixing Chamber
24 Axis Deviation
25 Filter
26 Holding Groove for the Carrier Plate or Nozzle, respectively
27 Inner Surface Part of the Nozzle
28 Opening in the Cover of the Suction Filter Housing
A Vertical Longitudinal Cut Plane
B Horizontal Longitudinal Cut Plane

The invention claimed is:

1. An intake charged double chamber vane cell pump (1) for delivering a liquid to a motor vehicle, the intake charged pump (1) comprising:

a housing (2) with an inner space (3) located therein, a pump rotor is arranged within the inner space of the housing and rotates about a rotational axis, an intake duct for the liquid extending to first and second inlets (18, 19) of the pump, a pressure area (11, 12) of the pump being linked to a pressured duct (9) through which a jet stream (10), from the pressure area (11, 12), is transported to the first and the second inlets (18, 19) of the pump, a nozzle configuration (13, 14), in the intake duct, for accelerating the liquid which is returned with the jet stream (10) and for supporting suction of a suction stream (8) of the liquid from a storage container, the intake duct being positioned in a front of the housing (2) of the pump (1) and designed as a cylindrical mixing chamber (6) so that the suction stream (8) is injected into the cylindrical mixing chamber (6), the cylindrical mixing chamber defines a chamber longitudinal axis which is directed tangentially to the inner space of the housing and offset from the rotational axis of the pump rotor, a nozzle (13) of the nozzle configuration (13, 14) having an output end that is spaced, along the chamber longitudinal axis, upstream of and apart from the cylindrical mixing chamber by an axial distance, the nozzle leading into the cylindrical mixing chamber (6) at an acute angle in a way so that the jet stream (10), exiting from the nozzle (13), creates a common mixing stream (15) with the sucked in suction stream (8) from the storage container, through which, to one of a front suction pocket (4) at the first inlet and a back suction pocket (5) at the second inlet of the double chamber pump (1), in each case, a respective partial stream (16, 17), having a common pressure and a common same energy content, being delivered, and the front and the back suction pockets (4, 5) are each designed as pairs at each side of the housing (2) of housing lids (21) and the nozzle (13) has a radially inner shell surface (27) that is asymmetrical with respect to the nozzle longitudinal axis.

2. The pump according to claim 1, wherein starting at the cylindrical mixing chamber (6), the housing (2) has the first inlet (18) to the front suction pocket (4) and the second inlet (19) to the back suction pocket (5), the front and the back suction pockets (4, 5) are positioned diametrically opposite one another in the pump, and the back suction pocket (5) is connected, via a ring duct (20), with the cylindrical mixing chamber (6).

3. The pump according to claim 1, wherein the nozzle (13) is arranged to direct the jet stream into the cylindrical mixing chamber (6) which mixes the jet stream with the suction stream to create the common mixing stream and causes the common mixing stream to divide into a first respective partial stream (16), which flows to the front suction pocket (4), and a second respective partial stream (17), which flows through the back suction pocket (5), the second respective partial stream is brought at an inner wall of the cylindrical mixing chamber (6) to a ring duct (20) that extends, radially around the rotational axis of the pump rotor, and to the back suction pocket (5).

4. The pump according to claim 1, wherein a longitudinal axis (22) of the nozzle (13) is tilted in at least one of a vertical and a horizontal longitudinal sectional plane (A, B) at an angle (a) of approximately 15° to 45° with respect to the chamber longitudinal axis (23) of the cylindrical mixing chamber (6).

5. The pump according to claim 4, wherein an inlet of the nozzle (13) is positioned in the vertical longitudinal sectional plane (A), with respect to the chamber longitudinal axis (23) of the cylindrical mixing chamber (6), at an axis deviation of approximately 15% to 25% of a diameter of the cylindrical mixing chamber (6).

6. The pump according to claim 1, wherein a longitudinal axis (22) of the nozzle (13) is tilted in at least one of a vertical and a horizontal longitudinal sectional plane (A, B) at an angle ($\alpha$) of approximately 15° to 20° with respect to the chamber longitudinal axis (23) of the cylindrical mixing chamber (6).

7. The pump according to claim 1, wherein the nozzle (13) defines a nozzle longitudinal axis and has an inlet, the nozzle is positioned with respect to the chamber longitudinal axis (23) of the cylindrical mixing chamber (6) such that the nozzle longitudinal axis at the inlet of the nozzle is spaced from the chamber longitudinal axis of the cylindrical mixing chamber by a distance that is approximately 15% to 20% of a diameter of the cylindrical mixing chamber (6).

8. An intake charged double chamber vane cell pump (1) for delivering a liquid to a motor vehicle, the intake charged pump (1) comprising:

a housing (2) with an inner space (3) located therein, a pump rotor is arranged within the inner space of the housing and rotates about a rotational axis, an intake duct for the liquid extending to first and second inlets (18, 19) of the pump, a pressure area (11, 12) of the pump being linked to a pressured duct (9) through which a jet stream (10), from the pressure area (11, 12), is transported to the first and the second inlets (18, 19) of the pump, a nozzle configuration (13, 14), in the intake duct, for accelerating the liquid which is returned with the jet stream (10) and for supporting suction of a suction stream (8) of the liquid from a storage container, the intake duct being positioned in a front of the housing (2) of the pump (1) and designed as a cylindrical mixing chamber (6) so that the suction stream (8) is injected into the cylindrical mixing chamber (6), the cylindrical mixing chamber defines a chamber longitudinal axis which is directed tangentially to the inner space of the housing and offset from the rotational axis of the pump rotor, a nozzle (13) of the nozzle configuration (13, 14) having an output end that is spaced, along the chamber longitudinal axis, upstream of and apart front the cylindrical mixing chamber by an axial distance, the nozzle leading into the cylindrical mixing chamber (6) at an acute angle in a way so that the jet stream (10), exiting from the nozzle (13), creates a common mixing stream (15) with the sucked in suction stream (8) from the storage container, through which, to one of a front suction pocket (4) at the first inlet and a back suction pocket (5) at the second inlet of the double chamber pump (1), in each case, a respective partial stream (16, 17), having a common pressure and a common same energy content, being delivered, and the nozzle configuration (13, 14) comprises of a carrier plate (14), and the nozzle (13) is either embedded or designed into the carrier plate, and the carrier plate (14) is either:

a component of a suction filter enclosure (7), or is fixed at an output of the pressure duct (9) within a holding groove (26) of the suction filter enclosure (7).

9. An intake charged pump (1) for delivering a liquid to a motor vehicle, the intake charged pump (1) comprising:

a housing (2) with an inner space (3) located therein, an intake duct for the liquid extending to an intake area (18, 19) of the pump, a pressure area (11, 12) of the pump being linked to a pressured duct (9) through which a jet stream (10), from the pressure area (11, 12), is transported to the intake area (18, 19) of the pump, a nozzle configuration (13, 14), in the intake duct, for accelerating the liquid which is returned with the jet stream (10) and for supporting suction of a suction stream (8) of the liquid from a storage container, the intake duct being positioned in a front of the housing (2) of the pump (1) and designed as a cylindrical mixing chamber (6) so that the suction stream (8) is injected into the mixing chamber (6), a nozzle (13) of the nozzle configuration (13, 14) leading into the mixing chamber (6) at an acute angle in a way so that the jet stream (10), exiting from the nozzle (13), creates a common mixing stream (15) with the sucked in suction stream (8) from the storage container, through which, to one of a front suction pocket (4) and a back suction pocket (5) of the double chamber pump (1), in each case, a respective partial stream (16, 17), having a common pressure and a common same energy content, being delivered, and the nozzle (13) defining a nozzle longitudinal axis (22) and having a radially inner shell surface (27) that is asymmetrical with respect to the nozzle longitudinal axis.

10. An intake charged pump (1) of a motor vehicle for delivering a liquid, the pump comprising:

a housing (2) enclosing an inner space (3) that has an at least substantially circular cross section and defines a rotational axis about which a pump rotor is rotatable, and a fluid intake duct extending to intake areas (18, 19) of the pump;

a pressure area (11, 12) of the pump being linked to a pressured duct (9) through which a jet stream (10) from the pressure area (11, 12) being directed toward the intake areas (18, 19) of the pump;

a nozzle configuration (13, 14) being arranged in the fluid intake duct for accelerating the liquid returning in the jet stream (10) and enhancing flow of a suction stream (8) of the liquid from a storage container;

the intake duct being positioned in front of the housing (2) of the pump (1) and designed as a cylindrical mixing chamber (6) which defines a longitudinal axis that is directed tangentially with respect to a circumference of the inner space of the housing and offset from the rotational axis, and the flow of the suction stream (8) being directed into the mixing chamber (6);

a nozzle (13) of the nozzle configuration (13, 14) conducting the jet stream (10) into the mixing chamber (6) at an acute angle for mixing with the suction stream from the storage container and forming a common mixing stream (15), the nozzle directing a first partial stream to a front intake pocket (4) and a second partial stream to a back suction pocket (5) such that, at the respective front and the rear intake pockets, the first and the second partial streams being at substantially equal pressures and have substantially equal energy contents; and the nozzle configuration (13, 14) comprises a carrier plate (14), and the nozzle (13) is either embedded or designed into the carrier plate, and the carrier plate (14) is either:

a component of a suction filter enclosure (7), or is fixed at an output of the pressure duct (9) within a holding groove (26) of the suction filter enclosure (7).

* * * * *